US009293860B1

(12) United States Patent
Kim et al.

(10) Patent No.: US 9,293,860 B1
(45) Date of Patent: Mar. 22, 2016

(54) CONNECTOR FOR A VEHICLE

(71) Applicants: HYUNDAI MOTOR COMPANY, Seoul (KR); KIA MOTORS CORPORATION, Seoul (KR); KUM CO., LTD., Ulsan (KR)

(72) Inventors: Sung-Il Kim, Hwaseong-si (KR); Sung-Won Jeon, Ulsan (KR); Dong-Gun Moon, Ulsan (KR)

(73) Assignees: HYUNDAI MOTOR COMPANY, Seoul (KR); KIA MOTORS CORPORATION, Seoul (KR); KUM CO., LTD., Ulju-Gun, Ulsan (KR)

( * ) Notice: Subject to any disclaimer, the term of this patent is extended or adjusted under 35 U.S.C. 154(b) by 0 days.

(21) Appl. No.: 14/543,881

(22) Filed: Nov. 17, 2014

(30) Foreign Application Priority Data

Sep. 22, 2014 (KR) ..... 10-2014-0126183

(51) Int. Cl.
*H01R 13/62* (2006.01)
*H01R 13/629* (2006.01)

(52) U.S. Cl.
CPC .... *H01R 13/62927* (2013.01); *H01R 13/62933* (2013.01)

(58) Field of Classification Search
CPC ..... H01R 13/62905; H01R 13/62927; H01R 13/62933; H01R 13/62955
See application file for complete search history.

(56) References Cited

U.S. PATENT DOCUMENTS 5,292,267 A * 3/1994 Kobayashi ..... G06F 1/1632 439/247
5,573,417 A * 11/1996 Hashizawa ..... B60L 11/1818 439/310
5,577,920 A * 11/1996 Itou ..... B60L 11/1846 439/310
8,246,365 B2 8/2012 Shishikura et al.

FOREIGN PATENT DOCUMENTS

JP 4917656 B2 4/2012
KR 10-0988793 B1 10/2010
KR 10-1360808 B1 2/2014

* cited by examiner

*Primary Examiner* — Khiem Nguyen
(74) *Attorney, Agent, or Firm* — McDermott Will & Emery LLP

(57) ABSTRACT

A connector and connector system for a vehicle, as well as a method of operating the connector, are provided. The connector includes a connector housing that has slide holes formed at both ends of a receiving surface and extending in the longitudinal direction of the connector housing. A slide bar is mounted slideably in the longitudinal direction of the connector housing, with an end inserted in the slide holes. A lever is mounted at the other end of the slide bar and has one end turnably coupled to the receiving surface of the connector housing. The lever is configured to pivot in a height direction of the connector housing, press the slide bar further into the slide holes and fix a counter connector to the connector housing, when being turned.

10 Claims, 5 Drawing Sheets

CONNECTOR FOR A VEHICLE

CROSS-REFERENCE TO RELATED APPLICATION

This application claims the benefit of priority to Korean Patent Application No. 10-2014-0126183 filed in the Korean Intellectual Property Office on Sep. 22, 2014, the entire contents of which are incorporated herein by reference.

TECHNICAL FIELD

The present disclosure relates to a connector, a method for operating the connector, and a connector system for a vehicle. More particularly, the present disclosure relates to a connector for a vehicle which stably combines two connectors by preventing distribution of force when a lever is operated and by facilitating coupling and separating of the lever, a method for operating the connector, and a connector system including the abovementioned connector.

BACKGROUND

In general, connectors are electric parts that electrically connect a power source and a device, a device and a device, or parts in devices, using a terminal therein, and a pair of connectors that can be combined with each other are combined and terminals therein are electrically connected.

Those connectors are physically combined by a force of a user or a worker, so when the number of terminals in the connectors increases, the force for combining the connectors increases, and there is a need for a large combining force to firmly combine the terminals.

Accordingly, a lever that can be turned is disposed on connectors having a plurality of terminals in order to generate a large combining force when the connectors are connected. The connectors are combined in the lever housing by the lever, and such connectors are called lever type connectors.

However, those connectors with a lever of the related art require separate connecting members for installing the lever that can freely turn in the lever housing, such that the total number of parts of the connectors increases and the structure combining the parts is complicated.

Further, there is a need of a space for keeping or carrying the connectors due to the lever capable of freely turning on the connectors and the lever is damaged by an external force or interferes with other connectors and levers when it is unexpectedly turned with respect to the housing of the connectors.

Further, the lever should be at a specific position, when a connector is inserted to be combined with a counter connector through the level, but when the lever freely turns with respect to the housing of the connector, a work has to turn the lever to a specific position in person to combine the connector with the counter-connector, so efficiency of combining work reduces.

Further, there are problems in that as the total number of parts of the connectors increases, the manufacturing cost increases, and as the combining structure is complicated, it is difficult to couple and separate the lever and it is structurally weaker.

The above information disclosed in this Background section is only for enhancement of understanding of the background of the inventive concept and therefore it may contain information that does not form the prior art that is already known in this country to a person of ordinary skill in the art.

SUMMARY

The present disclosure has been made in an effort to provide a connector, connector system, and a method for operating a connector having advantages of minimizing the number of parts and simplifying the connection structure by forming a slide bar integrally on a connector housing and enabling a lever to be coupled and separated by the slide bar.

An exemplary embodiment of the present inventive concept provides a connector for a vehicle which includes: a connector housing that has slide holes formed at both ends of a receiving surface that are configured to extend through the connector housing in the longitudinal direction. A slide bar is mounted slideably in the longitudinal direction of the connector housing, with an end inserted in the slide holes. A lever is mounted at the other end of the slide bar with one end turnably coupled to the receiving surface of the connector housing The lever is configured to pivot in a height direction of the connector housing, press the slide bar further into the slide holes, and fix a counter connector to the connector housing, when being turned by a user.

In certain embodiments, he connector housing may have a counter surface substantially perpendicular to the receiving surface, and connector coupling portions that have a plurality of insertion holes. The connector coupling portions may protrude at the centers of the counter surface and an opposing surface of the connector housing with the counter connector coupled on the counter surface. The connector housing may also include a lever coupling portion that protrudes from the receiving surface between the slide holes, and has hinge rods at ends corresponding to the slide holes.

The lever may have a pair of hinge rings that are turnably coupled to the hinge rods and spaced at a set distance, a press plate that extends integrally from the hinge rings and is configured to receive an external force; and coupling rods that protrude laterally in the width direction of the press plate, between the hinge rings and the press plate, and are turnably coupled to the other end of the slide bar.

The lever may further have a locking hook formed at an end of the press plate closer to the hinge rings, between the hinge rings.

The lever coupling portion may have a locking groove that is formed on the side opposite to the counter connector, between the hinge rods, corresponding to the locking hook.

The slide bar may have insertions having at least one or more guide protrusions longitudinally arranged on inner facing surfaces of the insertions. The insertions may have housing ends and lever ends, with the housing ends slideably inserted in the slide holes. The slide bar may also have supports that connect the lever ends of the insertions and have guide grooves formed on the inner facing sides of the supports in the vertical direction of the connector housing so that the coupling rods are movably and turnably inserted therein.

The insertions each may have a guide rail integrally formed longitudinally on an outer side.

Rail holes may be longitudinally formed integrally in the slide holes, to correspond to the guide rails.

A connector system is provided. The system may include a connector housing having slide holes formed at both ends of a receiving surface. The slide holes may be configured to extend through the connector housing in a longitudinal direction of the connector housing. The connector housing may have a counter surface substantially perpendicular to the receiving surface. The system further includes a counter connector configured to be positioned on the counter surface of the connector housing. A slide bar may be mounted slideably in the longitudinal direction of the connector housing. The slide bar may have a housing end and a lever end. The housing end of the slide bar may be configured to be inserted into the slide holes. A lever may be mounted at the lever end of the slide bar. The lever may have one end turnably coupled to the receiving surface of the connector housing. The lever may be configured to pivot in a height direction of the connector housing, further press the slide bar into the slide holes and fix the counter connector to the counter surface of the connector housing, when turned by a user.

A method of operating a connector for a vehicle is provided. The method may include positioning a counter connector on a counter surface of a connector housing, and inserting a slide bar into slide holes on a receiving surface of the connector housing. The receiving surface may be substantially perpendicular to the counter surface of the connector housing. The method may further include mounting a lever on the slide bar while turnably coupling one end of the lever to the receiving surface of the connector housing. The lever may then be pivoted the lever in a height direction of the connector housing while pressing the slide bar further into the slide holes of the connector housing to fix the counter connector to the connector housing.

As described above, according to the connector for a vehicle of an exemplary embodiment of the present inventive concept, since the slide bar is integrally on the connector housing and the lever can be coupled and separated by the slide bar, it is possible to minimize the number of components and simplify the connection structure.

Further, since the lever is coupled and used only when the connector is combined, it is possible to minimize a space for keeping and carrying the connector and to prevent damage to the lever due to an external force or interference with another connector and lever.

Further, since it is possible to keep the lever temporarily fixed at a specific position, using the slide bar formed integrally with the connector housing, it is possible to improve efficiency of work for combining and prevent distribution of force when operating the lever.

Further, after the lever is locked, with the connectors combined, the lever keeps coupled to the connector housing, such that it is possible to prevent the connectors from separating due to unexpected turning of the lever.

DETAILED DESCRIPTION OF THE EMBODIMENTS

Figure 1:
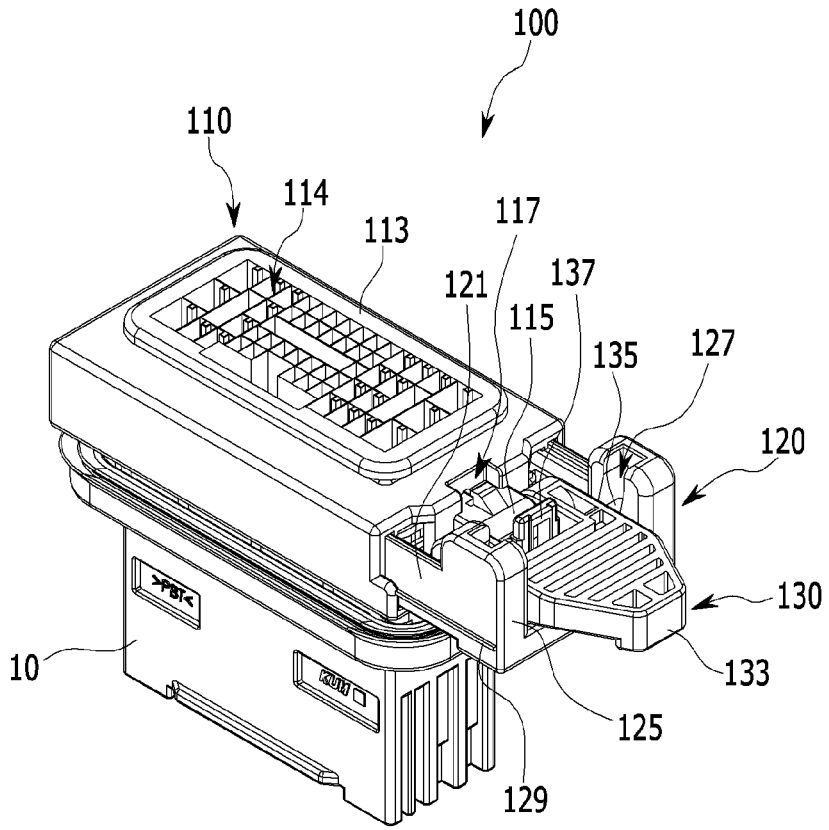
FIG. 1 is a perspective view showing a connector for a vehicle according to an exemplary embodiment of the present inventive concept.

An exemplary embodiment of the present inventive concept will hereinafter be described in detail with reference to the accompanying drawings.

First of all, the exemplary embodiments described herein and the configurations shown in the drawings are the most preferable exemplary embodiments of the present inventive concept and do not fully cover the spirit of the present inventive concept; therefore, it should be understood that there may be various equivalents and modifications that can replace them at the time of the application.

The parts not related to the description of the exemplary embodiments are not shown to make the description clear and like reference numerals designate like elements throughout the specification.

Further, the sizes and thicknesses of the configurations shown in the drawings are provided selectively for the convenience of description, so that the present inventive concept is not limited to those shown in the drawings and the thicknesses are exaggerated to make some parts and regions clear.

Throughout the present specification, unless explicitly described otherwise, "including" any components will be understood to imply the inclusion of other components rather than the exclusion of any other components.

Figure 2:
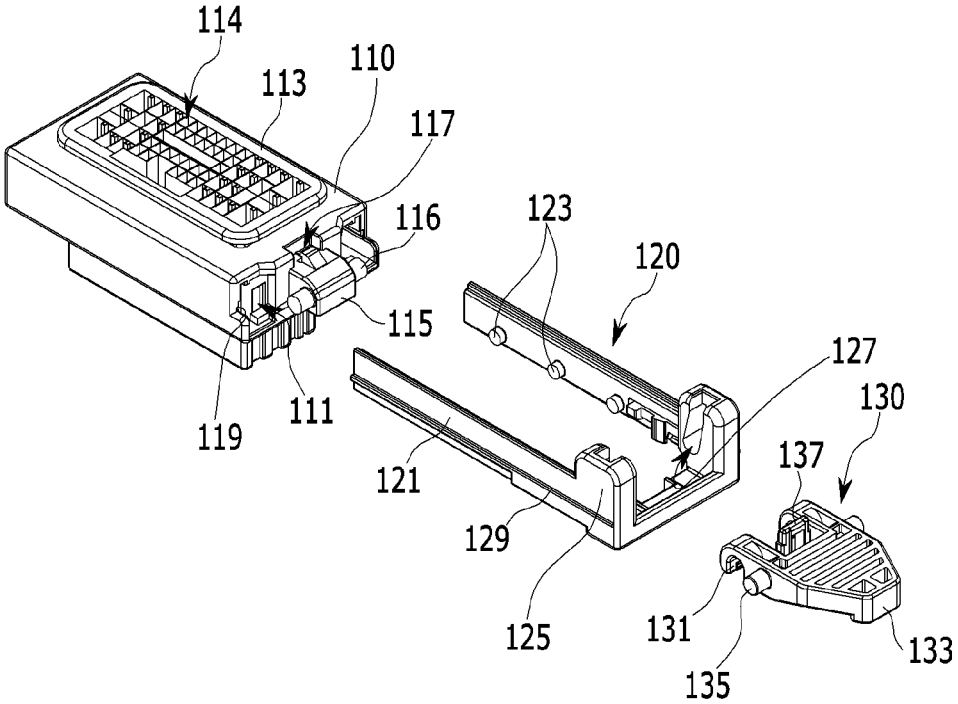
FIG. 2 is an exploded perspective view showing the connector for a vehicle according to an exemplary embodiment of the present inventive concept.
Figure 3:
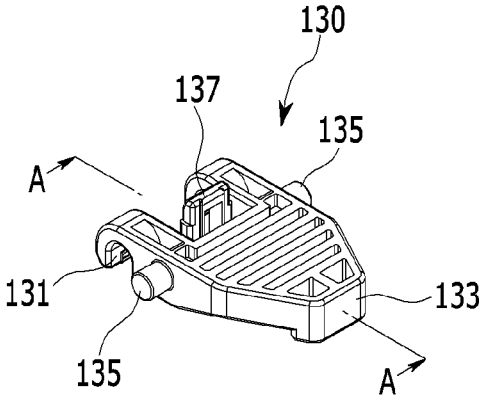
FIG. 3 is a perspective view showing a lever for the connector for a vehicle according to an exemplary embodiment of the present inventive concept.
Figure 4:
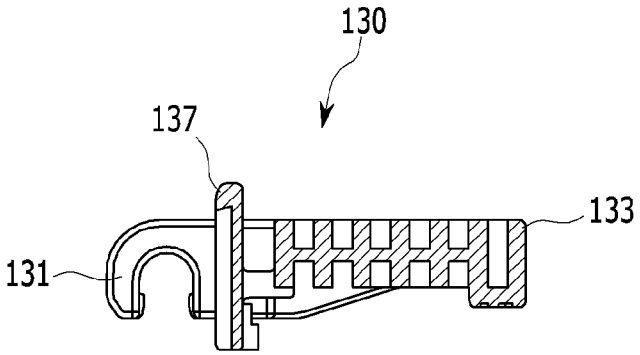
FIG. 4 is a cross-sectional view taken along line A-A in FIG. 3.

FIGS. 1 and 2 are a perspective view and an exploded perspective view showing a connector for a vehicle according to an exemplary embodiment of the present inventive concept, FIG. 3 is a perspective view showing a lever for the connector for a vehicle according to an exemplary embodiment of the present inventive concept, and FIG. 4 is a cross-sectional view taken along line A-A in FIG. 3.

Referring to the FIGS. 1-4, a connector 100 for a vehicle according to an exemplary embodiment of the present inventive concept has a minimum number of components and a simple connection structure by forming a slide bar 120 integrally on a connector housing 110 and enabling a lever to be coupled and separated by the slide bar 120.

To this end, the connector 100 for a vehicle according to an exemplary embodiment of the present inventive concept, as shown in FIGS. 1 and 2, includes a connector housing 110, a slide bar 120, and a lever 130.

First, the connector housing 110 defines the outer shape and may have slide holes 111 formed at both ends of a receiving surface. The slide holes are configured to penetrate the receiving surface and extend through the connector housing in the longitudinal direction.

The connector housing 110 may have a rectangular parallelepiped shape and may be made of a synthetic resin that is an insulator.

The connector housing 110 has connector coupling portions 113 and a lever coupling portion 115.

In the present exemplary embodiment, the connector coupling portions 113 have a plurality of insertion holes 114 where terminals (not shown) are inserted. The connector coupling portions 113 are disposed on opposing surfaces substantially perpendicular to the receiving surface of the connector housing 110 and protrude at the centers of the opposing surface, so a counter connector 10 is coupled to one of the opposing surfaces. The surface to which the counter connector 10 is coupled is hereinafter referred to as the counter surface.

The insertion holes 114 of the connector coupling portions 113 may be formed through the connector housing 110.

The lever coupling portion 115 protrudes from the receiving surface of the connector housing 110 between the slide holes 111.

The lever coupling portion 115 has hinge rods 116 at both sides corresponding to the slide holes 111.

In the present exemplary embodiment, the slide bar 120 is mounted slideably in the longitudinal direction of the connector housing 110, with an end inserted in the slide holes 111.

The slide bar 120 is composed of insertions 121 and supports 125.

The ends of the insertions 121 are slideably inserted in the slide holes 111 and one or more guide protrusions 123 are arranged longitudinally on the inner facing sides of the insertions 121.

In certain embodiments, the guide protrusions 123 may be formed at three positions spaced at regular intervals in the longitudinal direction of the insertions 121.

The insertions 121 may have a guide rail 129 integrally protruding on their outer sides and formed in the longitudinal direction.

Rail groves 119 may be formed integrally with the slide holes 111 in the longitudinal direction to correspond to the guide rails.

That is, when the insertions 121 of the slide bar 120 are inserted and received in the slide holes 111, the guide rails 129 are received in the rail grooves 119, such that they stably guide the slide bar 120.

In the present exemplary embodiment, the supports 125 connect the ends of the insertions 121 opposing the ends inserted into the slide holes 111 and each have a guide groove 127 on the inner sides facing each other in the height direction of the connector housing 110.

The guide grooves 127 are formed to temporarily fix the lever 130 to the slide bar 120, when the lever 130 is coupled to the connector housing 110, and to allow the slide bar 120 and the lever 130 to move together, when the lever 130 is operated, and in the following description, the lever 130 will be described first and then the function will be described.

The lever 130 is mounted at the other end of the slide bar 120 and can slide and turn in the height direction of the connector housing 110.

One end of the lever 130 is turnably coupled to the side of the connector housing 110 where the slide holes 111 are formed, so when it is turned by a user, it inserts the slide bars 121 into the slide holes 111 and fixes the counter connector 10, which is combined with the connector housing 110, to the connector housing 110.

The lever 130, as shown in FIGS. 3 and 4, has hinge rings 131, a press plate 133, and coupling rods 135.

First, the hinge rings 131 are formed in a ring shape with a predetermined portion cut off, turnably coupled to the hinge rods 116 of the lever coupling portion 115, and spaced with a predetermined gap in a pair. In the present exemplary embodiment, the press plate 133 integrally extends from the hinge rings 131 and receives a force from a user or a worker.

The coupling rods 135 protrude laterally in the width direction of the press plate 133, between the hinge rings 131 and the press plate 133, and are inserted in the guide grooves 127 of the supports 125 formed at the other end of the slide bar 120, to be able to slide and turn.

That is, the coupling rods 135 are inserted in the guide grooves 127 formed on the supports 125 connecting the other ends of the insertions 121 of the slide bar 120.

Accordingly, before the hinge rings 131 of the lever 130 are coupled to the hinge rods 116, the coupling rods 135 are inserted from the open sides to the other sides of the guide grooves 127 and temporarily fixed to the other end of the slide bar 120.

Further, after the hinge rings 131 are coupled, when the lever 130 is turned by a force applied to the press plate 133 of the lever 130 by a user or a worker, the coupling rods 135 inserted in the guide grooves 127 fully insert the insertions 121 of the slide bar 120 into the slide holes 111 while moving and turning in the turn direction of the lever 130 in the guide grooves 127.

Further, in the present exemplary embodiment, the lever 130 may further has a locking hook 137 formed at an end of the press plate 133 which faces the hinge rings 131, between the hinge rings 131.

The lever coupling portion 115 may have a locking groove 117 on a side opposite to the counter connector 10, between the hinge rods 116, corresponding to the locking hook 137.

That is, the locking hook 137 keeps inserted and locked in the locking groove 117, when the lever 130 fully turns with the counter connector 10 combined.

Accordingly, when the lever 130 fully turns, the counter connector 10 is fixed to the connector housing 110 by inserting the slide bar 120 in the slide holes 111 and the locking hook 137 keeps locked in the locking groove 117, such that the lever 130 can be fixed at the fully tuning position.

The operation and action of connector 100 for a vehicle according to an exemplary embodiment of the present inventive concept which as the configuration are described in detail hereafter.

Figure 5:
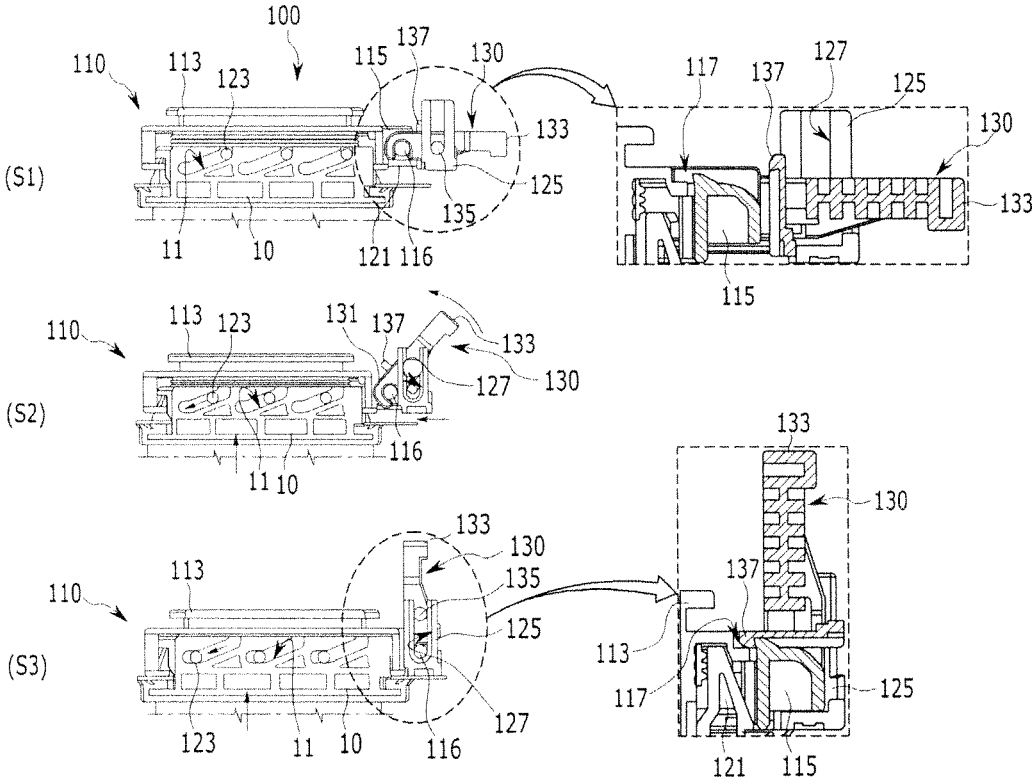
FIG. 5 is a view illustrating an operation state of the connector for a vehicle according to an exemplary embodiment of the present inventive concept.

FIG. 5 is a view illustrating an operation state of the connector for a vehicle according to an exemplary embodiment of the present inventive concept.

First, the connector 100 for a vehicle according to an exemplary embodiment of the present inventive concept is mounted on a vehicle, with terminals (not shown) connected with wires in the insertion holes 114.

In this state, the counter connector 10 is fitted on the other surface of the connector coupling portion 113 of the connector housing 110, as in (S1) of FIG. 5.

In this case, the other end of the slide bar 120 partially protrudes out of the connector housing 110 and the hinge rings 131 of the lever 130 are coupled to the hinge rods 116 of the lever coupling portion 115, with the coupling rods 135 inserted in the guide grooves 127.

Accordingly, since the coupling rods 135 are inserted in the guide grooves 127, with the hinge rings 131 coupled to the hinge rods 116, the lever 130 is positioned on a straight line together with the connector housing 110 by the slide bar 120 protruding outward.

The guide protrusions 123 are inserted in guide channels 11 formed at the counter connector 10 to correspond to the guide protrusions 123.

Thereafter, when a user or a worker applies a force to the press plate 133 to turn the lever 130, the lever 130 is turned about the hinge rods 116, as in (S2) of FIG. 5.

Accordingly, the coupling rods 135 of the lever 130 are moved up from the lower portions of the guide grooves 127 and insert the insertions 121 of the slide bar 120 into the slide holes 111.

In this process, the guide protrusions 123 slide along the guide channels 11 formed at an angle downward with respect to the combination direction of the counter connector 10 and move the counter connector 10 closer to the connector housing 110, such that the counter connector 10 is firmly fixed.

When the lever 130 perpendicular to the counter connector 10 is fully turned in parallel with the counter connector 10, the insertions 121 of the slide bar 120 are fully inserted in the slide holes 111, as in (S3) of FIG. 5.

In this process, the guide protrusions 123 bring the counter connector 10 in close contact with the connector housing 110 by moving along the guide channels 11 of the counter connector 10.

Further, the lever 130 is fixed with the locking hook 137 locked in the locking groove 117 of the lever coupling portion 115, such that it cannot return to the initial position, before a user or a worker applies a force.

Separating the connector 100 and the counter connector 10 is performed in the reverse order of the process described above.

That is, when a user or a worker turns the lever 130 in the opposite direction by pressing the press plate 133 of the lever 130, the locking hook 137 is unlocked from the locking groove 117 and moves the insertions 121 of the slide bar 120 out of the slide grooves 111.

The insertions 121 can stably reciprocate, because the guide rails 129 formed on the outer sides of the insertions 121 move along the rail grooves 119 formed in the slide holes 111.

Accordingly, the protrusions 123 are taken out of the guide channels 11 of the counter connector 10 and move the counter connector 10 in the opposite direction to the combination direction with the connector housing 110, such that the connector 100 and the counter connector 10 are separated.

Therefore, according to the connector 100 for a vehicle of an exemplary embodiment of the present inventive concept, since the slide bar 120 is formed integrally with the connector housing 110 and the lever 130 can be coupled and separated by the slider bar 120, the number of components can be minimized and the connection structure can be simplified.

Further, since the lever 130 is coupled and used only when the connector 100 is combined, it is possible to minimize a space for keeping and carrying the connector 100 and to prevent damage to the lever 130 due to an external force or interference with another connector and lever.

Further, since it is possible to keep the lever 130 temporarily fixed at a specific position, using the slide bar 120 formed integrally with the connector housing 110, it is possible to improve efficiency of work for combining and prevent distribution of force when operating the lever 130.

Further, after the lever 130 is locked, with the connector 100 and the counter connector 10 combined, the lever 130 keeps coupled to the connector housing 110, such that it is possible to prevent the connectors 10 and 100 from separating due to unexpected turning of the lever 130.

While this inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A connector for a vehicle, comprising:

a connector housing having slide holes formed at both ends of a receiving surface, the slide holes extending through the connector housing in a longitudinal direction of the connector housing;

a slide bar that is mounted slideably in the longitudinal direction of the connector housing, the slide bar having a housing end and a lever end, with the housing end inserted in the slide holes; and a lever that is mounted at the lever end of the slide bar, the lever having one end turnably coupled to the receiving surface of the connector housing, the lever configured to pivot in a height direction of the connector housing, press the slide bar further into the slide holes and fix a counter connector to the connector housing, when turned.

2. The connector of claim 1, wherein the connector housing has:

a counter surface substantially perpendicular to the receiving surface, connector coupling portions having a plurality of insertion holes, the connector coupling portions protruding at the centers of the counter surface and an opposing surface of the connector housing, with the counter connector coupled on the counter surface; and a lever coupling portion that protrudes from the receiving surface, between the slide holes, and has hinge rods at ends corresponding to the slide holes.

3. The connector of claim 2, wherein the lever has:

a pair of hinge rings turnably coupled to the hinge rods and spaced at a set distance;

a press plate extending from the hinge rings, the press plate configured to receive an external force; and coupling rods that protrude laterally in the width direction of the press plate, between the hinge rings and the press plate, and are turnably coupled to the lever end of the slide bar.

4. The connector of claim 3, wherein the lever further has a locking hook formed at an end of the press plate close to the hinge rings, between the hinge rings.

5. The connector of claim 4, wherein the lever coupling portion has first and second opposing surfaces, where the first surface of the lever coupling portion is closer to the counter surface of the connector housing than the second surface of the lever coupling portion, and a locking groove formed on the second surface of the lever coupling portion, between the hinge rods, the locking groove corresponding to the locking hook.

6. The connector of claim 3, wherein the slide bar has:

insertions having at least one or more guide protrusions longitudinally arranged on inner facing surfaces of the insertions; the insertions having housing ends and lever ends, the housing ends slideably inserted in the slide holes, and supports that connect lever ends of the insertions and have guide grooves formed on inner facing surfaces of the supports in the vertical direction of the connector housing so that the coupling rods are movably and turnably inserted therein.

7. The connector of claim 6, wherein the insertions each have a guide rail integrally formed longitudinally on an outer side.

8. The connector of claim 7, wherein rail holes are longitudinally formed integrally in the slide holes the rail holes configured to correspond to the guide rails.

9. A connector system for a vehicle, the system comprising:

a connector housing having slide holes formed at both ends of a receiving surface, the slide holes extending through the connector housing in a longitudinal direction of the connector housing, the connector housing having a counter surface substantially perpendicular to the receiving surface;

a counter connector configured to be positioned on the counter surface of the connector housing;

a slide bar that is mounted slideably in the longitudinal direction of the connector housing, the slide bar having a housing end and a lever end, the housing end of the slide bar configured to be inserted into the slide holes;

and a lever that is mounted at the lever end of the slide bar, the lever having one end turnably coupled to the receiving surface of the connector housing, the lever configured to pivot in a height direction of the connector housing, further press the slide bar into the slide holes and fix the counter connector to the counter surface of the connector housing, when turned.

10. A method of operating a connector for a vehicle, the method comprising:

positioning a counter connector on a counter surface of a connector housing;

inserting a slide bar into slide holes on a receiving surface of the connector housing, the receiving surface being substantially perpendicular to the counter surface of the connector housing;

mounting a lever on the slide bar while turnably coupling one end of the lever to the receiving surface of the connector housing;

pivoting the lever in a height direction of the connector housing while pressing the slide bar further into the slide holes of the connector housing to fix the counter connector to the connector housing.

* * * * *